US009007219B2

(12) United States Patent
Perle

(10) Patent No.: US 9,007,219 B2
(45) Date of Patent: Apr. 14, 2015

(54) SLEEP-DISRUPTING APPARATUS FOR A VEHICLE

(71) Applicant: Harvey Perle, Minneapolis, MN (US)

(72) Inventor: Harvey Perle, Minneapolis, MN (US)

( * ) Notice: Subject to any disclaimer, the term of this patent is extended or adjusted under 35 U.S.C. 154(b) by 36 days.

(21) Appl. No.: 13/854,464

(22) Filed: Apr. 1, 2013

(65) Prior Publication Data

US 2014/0292521 A1 Oct. 2, 2014

(51) Int. Cl.

| | |
|---|---|
| ***G08B 23/00*** | (2006.01) |
| ***G08B 21/06*** | (2006.01) |
| ***G08B 6/00*** | (2006.01) |

(52) U.S. Cl.

CPC . *G08B 21/06* (2013.01); *G08B 6/00* (2013.01)

(58) Field of Classification Search

USPC ..... 340/575, 407.1, 571, 573.1, 582, 588, 340/635, 636.11–636.15, 641, 667–670, 340/683, 692

See application file for complete search history.

(56) References Cited

U.S. PATENT DOCUMENTS

| | | | | |
|---|---|---|---|---|
| 5,952,929 | A * | 9/1999 | Yasushi et al. | 340/575 |
| 6,056,357 | A * | 5/2000 | Fukuoka | 297/217.3 |
| 6,313,749 | B1 * | 11/2001 | Horne et al. | 340/575 |
| 2004/0222879 | A1 * | 11/2004 | Sawyer et al. | 340/407.1 |
| 2007/0200392 | A1 * | 8/2007 | Eiswirth | 296/190.02 |

* cited by examiner

*Primary Examiner* — Daniel Previl

(74) *Attorney, Agent, or Firm* — Thomas, Karceski & Karmilovich, PC

(57) ABSTRACT

A sleep disrupting apparatus disposed in a vehicle includes a processor and at least one vibration generator. The vibration generator is connected to the processor and is located in the vehicle in a position proximate to a passenger such that vibrations generated by the vibration generator are transmitted to the passenger. The processor determines a time index, generates at least three vibration signals consistent with the time index, and transmits the three vibration signals to the at least one vibration generator. The three vibration signals are separated from one another by two time intervals. The two time intervals are not equal to one another.

18 Claims, 3 Drawing Sheets

SLEEP-DISRUPTING APPARATUS FOR A VEHICLE

CROSS-REFERENCE TO RELATED APPLICATION(S)

This is a first-filed United States Patent Application that does not rely on any other patent application for priority.

FIELD OF THE INVENTION

The present invention concerns a device, disposed in or on a vehicle, to disrupt the onset of sleep of a person in the vehicle. More specifically, the present invention encompasses an apparatus and a method that provides intermittent, disruptive signals to a driver of a vehicle to disrupt the slumberous tendencies of the driver, such as may occur when driving for extended periods of time.

DESCRIPTION OF THE RELATED ART

As should be apparent to the average person, it is possible that a person driving a car or other vehicle may become sleepy while driving.

When a person drives a car (or other vehicle) for extended periods of time, the tendency for the driver to become sleepy is increased.

It is also possible for a driver to succumb to a mental state referred to commonly as "highway hypnosis." Highway hypnosis is a hypnotic or semi-hypnotic state that a driver may experience when driving on a highway. While highway hypnosis is described in the literature in many different ways, the generally accepted definition addresses a mental state of a driver where the driver, while conscious, is not aware of his or her surroundings, resulting in extended periods of operation of the vehicle with a distorted perception of the passage of time.

Regardless of the reason(s) for distraction, driving in a less than fully alert state has the potential for undesirable consequences that any driver is likely to wish to avoid.

To combat sleepiness, drivers often employ techniques that may assist to return the driver to a more alert condition. For example, the driver may roll down the windows or turn up the volume of the radio in the car.

While these common remedies may be effective, drivers alternatively may rely on one or more devices while driving.

One known device incorporates a headphone that hooks onto the driver's ear. The device measures the tilt of the driver's head. If the driver's head should tilt to a predetermined angle indicative of the onset of sleep, the device generates an audible alarm to return the driver to a more alert state.

Other, similar devices are known in the prior art. As a general rule, these devices respond to input from the driver (i.e., nodding of the driver's head) that suggests a drowsy or sleeping state.

U.S. Pat. No. 6,056,357 (hereinafter "the '357 Patent") describes an apparatus for vibrating seats that are effective in preventing a driver from dozing off during driving. (The '357 Patent at the Abstract.) The '357 Patent describes a vibrator having a motor 7 with a pair of unbalanced weights 16 to generate vibrations beneath a seat cushion member 3. (The '357 Patent at col. 2, line 33, through col. 3, line 7.) The vibrator includes a vibration control with three positions: (1) a weak position whereby 1,200 rpm may impart a vibration of 37 kgf, 5 mm in amplitude, and 20 Hz in frequency, (2) a middle position whereby 1,700 rpm may impart a vibration of 53.3 kgf, 7 mm in amplitude, and 28 Hz in frequency, and (3) a strong position whereby 2,500 may impart a vibration of 83.3 kgf, 10 mm in amplitude, and 42 Hz in frequency. (The '357 Patent at col. 3, lines 15-26.) In every level, a 20-second vibration and 10-second interval repeats several times (such as three times). (The '357 Patent at col. 3, lines 26-29.)

As should be apparent, the '357 Patent relies on repetitive vibration to prevent a driver from dozing off. A driver, however, may become used to repetitive vibration, thereby undermining the efficacy of the vibrations.

As a result, while the prior art describes devices that help a driver to remain in an alter state while operating a vehicle, there remains a continuing need for devices that discourage the onset of sleep or disrupt sleep, should a driver become drowsy or unconscious while operating the vehicle.

SUMMARY OF THE INVENTION

The present invention addresses one or more deficiencies associated with the prior art.

In one contemplated embodiment, the present invention provides a sleep disrupting apparatus in a vehicle that includes a processor and at least one vibration generator connected to the processor. The vibration generator is disposed in the vehicle in a position proximate to a passenger such that vibrations generated by the vibration generator are transmitted to the passenger. The processor determines a time index, generates at least three vibration signals consistent with the time index, and transmits the three vibration signals to the at least one vibration generator. The three vibration signals are separated from one another by two time intervals. The two time intervals are not equal to one another.

In one contemplated embodiment, the at least one vibration generator includes two vibration generators. The two vibration generators are disposed within the seat and the backrest of a driver's seat in the vehicle.

In another contemplated embodiment, the at least one vibration generator includes three vibration generators. The three vibration generators are disposed within a seat, a backrest, and a steering wheel of the vehicle.

It is also contemplated that the sleep disrupting apparatus of the present invention includes an input device connected to the processor to provide input from a user to the processor.

In a further embodiment, the sleep disrupting apparatus includes a speedometer that measures a speed of the vehicle and generates a speed signal that is transmitted to the processor and received as input by the processor.

It is also contemplated that the sleep disrupting apparatus may include a clock connected to the processor that generates a clock signal that is transmitted to the processor and received as input by the processor.

In one further contemplated embodiment of the present invention, the sleep disrupting apparatus includes a speaker connected to the processor to generate an audible alarm in response to an alarm signal from the processor.

In still another contemplated embodiment of the present invention, the sleep disrupting apparatus includes a transmitter/receiver connected to the processor to transmit signals from the processor and receive signals to be sent to the processor.

It is contemplated that the passenger will be a driver of the vehicle.

The present invention also provides for a method for disrupting sleep of a passenger of a vehicle. The method includes, via a processor, generating a time index setting a timing for the generation of at least three consecutive vibration signals, wherein the at least three consecutive vibration signals are separated from one another by two consecutive time intervals, via the processor, generating a vibration signal, via the processor, transmitting the vibration signal to at least one vibration generator disposed within the vehicle in proximity to a passenger such that vibrations generated by the vibration generator are transmitted to the passenger, via the at least one vibration generator, generating a vibration responsive to the vibration signal, via the processor, determining if all of the at least three vibration signals have been transmitted, and, if all of the vibration signals have not been transmitted, returning to the step of generating a vibration signal to generate a subsequent vibration signal.

In one contemplated embodiment, the method also includes receiving at least one input variable by the processor.

It is also contemplated that the at least one input variable is provided from the passenger via an input device.

The method also contemplates, with respect to one embodiment, that the at least two time intervals comprise a first time interval followed by a second time interval. In this variation, the first time interval is not equal to the second time interval.

In another contemplated embodiment of the present invention, the method further includes via the processor, generating an alarm signal, via the processor, transmitting the alarm signal to a speaker, and, via the speaker, generating an audible alarm.

It is contemplated that the at least one vibration generator may include two vibration generators disposed in a seat and a backrest of the vehicle.

It is also contemplated that the at least one vibration generator may include three vibration generators disposed in a seat, a backrest, and a steering wheel of the vehicle.

In addition, more than one of the at least one vibration generators may receive the vibration signal simultaneously.

Still further features of the present invention should be appreciated from the drawings appended hereto and from the discussion herein.

BRIEF DESCRIPTION OF THE DRAWINGS

The present invention will now be described in connection with the drawings appended hereto, in which.

DETAILED DESCRIPTION OF EMBODIMENT(S) OF THE INVENTION

The present invention will now be described in connection with one or more embodiments. Discussion of any one particular embodiment is intended to be illustrative of the breadth and scope of the invention. In other words, while attention is focused on specific embodiments, those embodiments are not intended to be limiting of the scope of the present invention. To the contrary, after appreciating the discussion and drawings presented herein, those skilled in the art will readily appreciate one or more variations and equivalents of the embodiments described and illustrated. Those variations and equivalents are intended to be encompassed by the present invention as though they were described herein.

Figure 1:
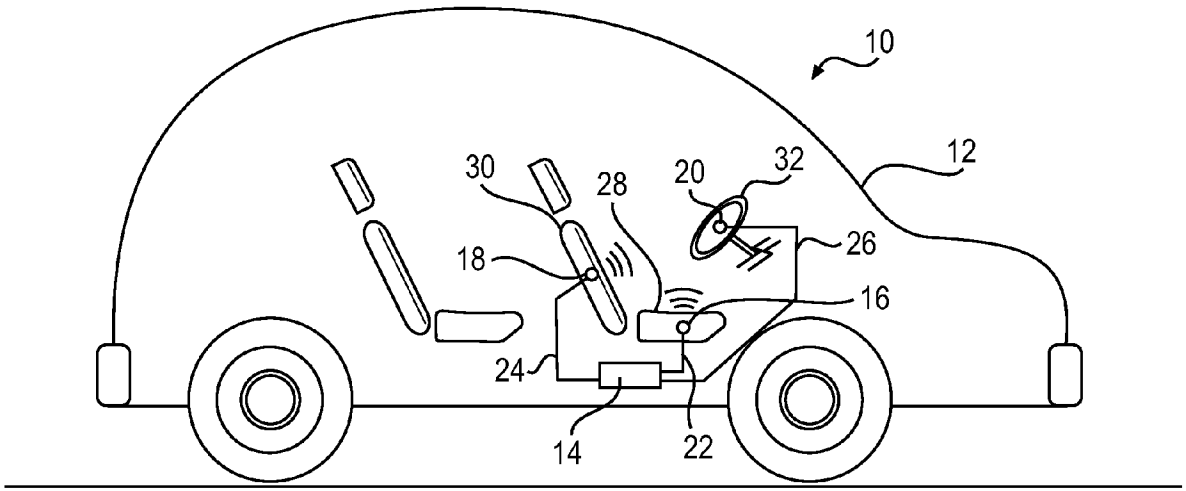
FIG. 1 is a graphical, side view of one embodiment of the sleep disrupting apparatus of the present invention as might be embodied in a vehicle such as a car.

FIG. 1 is a graphical, side view of one contemplated embodiment of the sleep disrupting apparatus 10 of the present invention. The sleep disrupting apparatus 10 also is referred to herein as a sleep disruptor 10, for brevity.

The sleep disruptor 10 is contemplated to be disposed in or on a vehicle 12, such as an automobile 12. As should be apparent to those skilled in the art, the sleep disruptor 10 may be disposed on any type of vehicle including, but not limited to, a bus, a train, an aircraft, a truck, a boat, etc. In other words, while the sleep disruptor 10 of the present invention is described in connection with a car 12, the present invention should not be understood to be limited to automobiles 12.

The sleep disruptor 10 of the present invention includes a processor 14 connected to one or more vibration generators 16, 18, 20 via communication lines 22, 24, 26.

As is apparent from FIG. 1, the first and second vibration generators 16, 18 are disposed in a driver's seat in the vehicle 12. Specifically, the first vibration generator 16 is disposed in the seat 28 and is, therefore, also referred to as the seat vibration generator 16. The second vibration generator 18 is disposed in the backrest 30. As a result, the second vibration generator 18 also is referred to as the backrest vibration generator 18.

The third vibration generator 20 is not disposed in driver's seat. Instead, the third vibration generator 20 is disposed in the steering wheel 32 of the vehicle 12. As such, the third vibration generator 20 also is referred to as the steering wheel vibration generator 20.

The seat vibration generator 16 is connected to the processor 14 via the first communication line 22. As shown, the backrest vibration generator 18 is connected to the processor 14 by the second communication line 24. Finally, in this embodiment, the steering wheel vibration generator 20 is connected to the processor 14 by the third communication line 26.

As should be apparent from FIG. 1, the processor 14 is connected such that it is capable of sending vibration signals to one or more of the vibration generators 16, 18, 20.

The communication lines 22, 24, 26 are contemplated to be wires lines connected between the processor 14 and the vibration generators 16, 18, 20. While wired lines are contemplated for this embodiment of the present invention, it should be apparent to those skilled in the art that the communication lines 22, 24, 26 need not be wired lines. One or more of the communication lines 22, 24, 26 may be wireless without departing from the scope of the present invention.

In an alternative embodiment, it is contemplated that the sleep disruptor 10 need not incorporate three communication lines 22, 24, 26. Instead, the processor 14 may be connected to a data bus that conveys the vibration signals to the vibration generators 16, 18, 20. In other words, one or more of the communication lines 22, 24, 26 may include shared connections with one or more of the vibration generators 16, 18, 20.

While three vibration generators 16, 18, 20 are illustrated, the sleep disruptor 10 of the present invention need not incorporate three vibration generators 16, 18, 20. To the contrary, the sleep disruptor 10 may incorporate a smaller number or a larger number of vibration generators 16, 18, 20 without departing from the scope of the present invention. Moreover, each individual vibration generator 16, 18, 20 may include multiple vibration generators at the designated location in the vehicle 12.

It is noted that the sleep disruptor 10 of the present invention is anticipated to include at least the seat vibration generator 16 and its associated communication line 22. This particular vibration generator 16 is preferred over the other vibration generators 18, 20, because the seat vibration generator 16 is contemplated to transmit suitable vibrations to the passenger to disrupt the onset of sleep or to wake up the passenger, should the passenger doze off.

Each of the vibration generators 16, 18, 20 are positioned so that vibrations generated thereby are transmitted readily to the driver. As such, the vibration generators 16, 18, 20 are disposed in positions proximate to the driver. As should be apparent, the seat vibration generator 16 will transmit vibrations to the driver's buttocks. The backrest vibration generator 18 will convey vibrations to the driver's back. Finally, the steering wheel vibration generator 20 is contemplated to generate vibrations that are received by one or both of the driver's hands.

The exact construction of the vibration generators 16, 18, 20 is not critical to the operation of the present invention. While electromechanical vibration generators are contemplated for use with the present invention, the vibration generators 16, 18, 20 may generate vibrations by any suitable means without departing from the scope of the present invention.

The operation of the sleep disruptor 10 will now be described.

The processor 14 is contemplated to incorporate programming that generates vibration signals, which are carried to one or more of the vibration generators 16, 18, 20. The programming may encompass software (i.e., coded instructions), may be hardwired into the processor 14, or may encompass a combination of hardware and software.

When one or more of the vibration generators 16, 18, 20 are activated by the vibration signal(s) generated by the processor 14, the vibration generators 16, 18, 20 generate vibrations that are perceptible to the passenger, as noted above. The vibrations provide one or more stimuli to disrupt slumberous tendencies of the passenger, such as the driver.

It is contemplated that the processor 14 incorporates programming that generates vibration signals in a random fashion. In other words, the processor 14 is contemplated to incorporate a random signal generator that generates random vibration signals that result in the generation of vibration signals at one or more predetermined time indices. The vibration signals are then issued to the vibration generators 16, 18, 20 according to the one or more of the established time indices. In addition, the vibration signals may be of different time durations and intensities, resulting in variable outputs by the processor 14.

As should be apparent to those skilled in the art, people are capable of adapting to repetitive stimuli. As such, it is believed that repetitive signals, generated at equal (or substantially equal) time intervals, may be ignored by a person, thereby defeating (or at least undermining) the sleep disrupting efficacy of the sleep disruptor 10. At least for this reason, it is preferred that the processor 14 generate the vibration signals in a non-repeating manner or at non-regular intervals.

It is noted that the exact method for generating the vibration signals by the processor 14 is not critical to the present invention. Therefore, any method, software, and/or hardware that assist with this aspect of the present invention is considered to fall within the scope of the present invention.

As is apparent from FIG. 1, three vibration generators 16, 18, 20 are incorporated into the vehicle 12. Where the sleep disruptor 10 includes plural vibration generators 16, 18, 20, it is contemplated that the vibration signals will be provided to the vibration generators 16, 18, 20 in a random fashion. This is believed to further enhance the sleep disrupting aspect of the present invention.

In one example, a first vibration signal may be provided to the seat vibration generator 16 at a start time interval. A second vibration signal may then be provided to the steering wheel vibration generator 20 after the passage of a first time interval. After passage of a second time interval, a third vibration signal may be provided to the backrest vibration generator 18.

As should be apparent, the first, second, and third vibration signals are provided according to a timeline (or time index) generated by the processor 14. The first, second, and third vibration signals are separated from one another by first and second time intervals. The first and second time intervals are not equal to one another.

Where the time index encompasses a period of time that permits the generation of more than three vibration signals, it is contemplated that two or more of the time intervals may be of the same duration. However, to prevent a driver from adapting to the length of successive time intervals, the present invention avoids employing two successive time intervals of the same temporal duration. In other words, time intervals of equal length do not follow one another in a repetitive fashion.

While the present invention contemplates that successive time intervals are non-equal in duration, the present invention is not limited only to circumstances where successive time intervals are unequal. The present invention also contemplates that successive time intervals may be equal. However, as noted this is not a preferred mode of operation of the present invention.

As also noted above, successive vibration signals preferably are not of equal intensity or duration. For example, the first vibration signal may have an intensity (on a scale of 1 to 10) of 5 and a duration of two seconds. The second vibration signal may have an intensity of 3 and a duration of five seconds. The third vibration signal may have an intensity of 7 and a duration of one second.

As should be apparent, two or more of the vibration generators 16, 18, 20 may be activated at the same time to further enhance the random behavior of the sleep disruptor 10 of the present invention. For example, the first vibration signal may be applied to the seat vibration generator 16, the second vibration signal may be applied to the backrest vibration generator 18, and the third vibration signal may be applied to the seat vibration generator 16 and the steering wheel vibration generator 20 at the same time.

Figure 2:
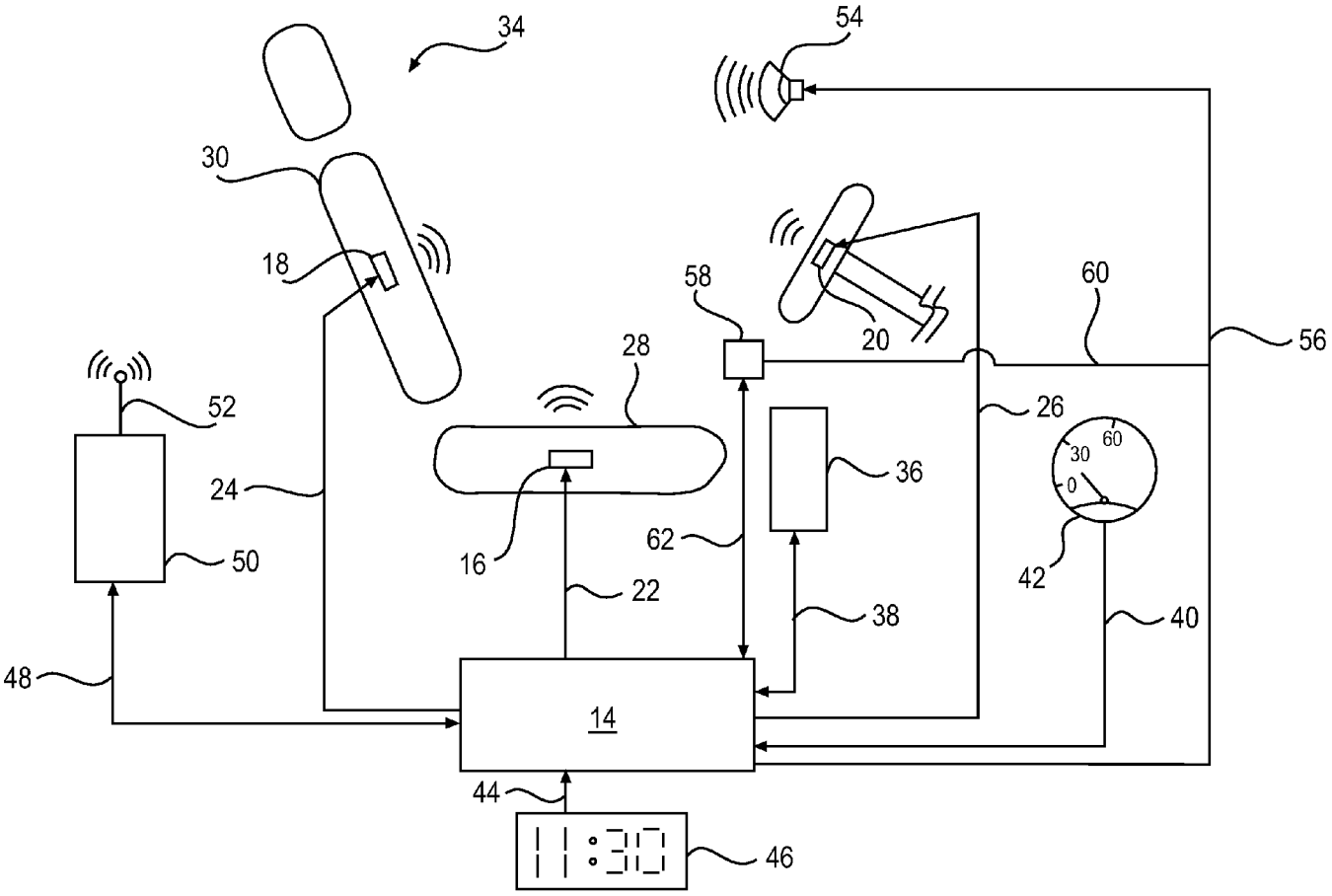
FIG. 2 is a graphical illustration of a second embodiment of the sleep disrupting apparatus of the present invention.

FIG. 2 is a graphical illustration of a second embodiment of a sleep disruptor 34 according to the present invention.

This second embodiment shares many of the same features as the first embodiment illustrated in FIG. 1. As a result, the same reference numbers are employed, where applicable.

In this second embodiment, the sleep disruptor 34 also includes an interface 36. The interface 36 is connected to the processor 14 via communication line 38, which may be wired or wireless. The interface 36 encompasses any type of input/output device that may be available to a driver of the vehicle 12. In one contemplated embodiment, the interface 36 may be a touch-sensitive screen that is provided in the vehicle 12. In another contemplated embodiment, the interface 36 may be a switch or a series of switches. In still another contemplated embodiment, the interface 36 may be a portable device, such as a smartphone, onto which control software has been loaded.

The interface 36 also may incorporate an output device, such as a display screen. The display is contemplated to provide an indication of the functions that are available to the user. The display may also indicate which functions of the present invention either are active or inactive, as required or as desired.

It is contemplated that the interface 36 will provide the driver at least with the ability to turn the sleep disruptor 34 on or off. In an advanced contemplated embodiment, the user may be able to adjust the operation of the sleep disruptor 34. For example, the interface 36 may permit the user to increase/decrease the frequency at which the sleep disruptor 34 activates. Alternatively, the interface 36 may permit the user to adjust the intensity and/or duration of the vibrations generated by the vibration generators 16, 18, 20. This functionality permits the user to adjust the operation of the sleep disruptor 34, depending upon the user's perceived level of sleepiness and the user's preferences.

While the interface 36 is illustrated as being incorporated into the car 12, such as through a suitable touch sensitive device that is positioned in the dashboard of the vehicle 12, it is contemplated that the interface 36 may be a mobile device (such as a smartphone) that connects wirelessly to the processor 14 when the driver is in the vehicle 12. If a portable interface 36 is employed, it is contemplated that the driver may select specific variables for the activation of the sleep disruptor 34 of the present invention. The, whenever the same driver sits behind the wheel of the vehicle 12 (or any other vehicle 12) equipped with the present invention, the driver's preset preferences will be taken into account by the processor 14.

In the embodiment illustrated in FIG. 2, the sleep disruptor 34 also includes a communication line 40 that connects the processor 14 to a speedometer 42. The speedometer 42 provides input to the processor 14 by providing some indication of the speed of the vehicle 12. The processor 14 may be programmed to alter the frequency at which vibration signals are generated based on the speed of the vehicle 12. For example, if the car 12 is moving at a higher rate of speed, the processor 14 may generate vibration signals at a greater frequency than at lower speeds.

The processor 14 also may include a communication line 44 that connects to a clock 46. The clock 46 may provide additional input for operation of the processor 14. For example, the clock 46 may be accessed if the driver selects to enable the sleep disruptor 34 at only selected times of the day, such as at night. The driver also may choose to enable the sleep disruptor 34 only for a predetermined period of time, such as for two hours. Still other temporal commands may be inputted, such as through the interface 36, that may require input from the clock 46.

The processor 14 may connect, via a communication line 48, to a transmitter/receiver 50 having an antenna 52. It may be desirable to connect the processor 14 to a transmitter/receiver 50 in instances where the processor 14 requires instructions from an external location, such as a transmitter connected to the Internet or a local server. As indicated above, it is contemplated that the driver may input user preferences, such as via software (or a graphical user interface) available through the Internet. When the driver then starts the vehicle 12, the user preferences may be uploaded from the external database to the processor 14 for operation of the sleep disruptor 34.

The sleep disruptor 34 also may include a speaker 54 that is connected to the processor 14 via a communication line 56. The speaker 54 may be provided to generate an audible signal, in response to an alarm signal generated by the processor 14, which may be employed separately or together with one or more of the vibration signals. In other words, the audible alarm signal may be generated by the processor 14 to operate in parallel with or separate from the vibration signals provided to the vibration generators 16, 18, 20. In this embodiment, alarms may be interposed between vibrations to further enhance the sleep disruptive aspects of the present invention.

Figure 3:
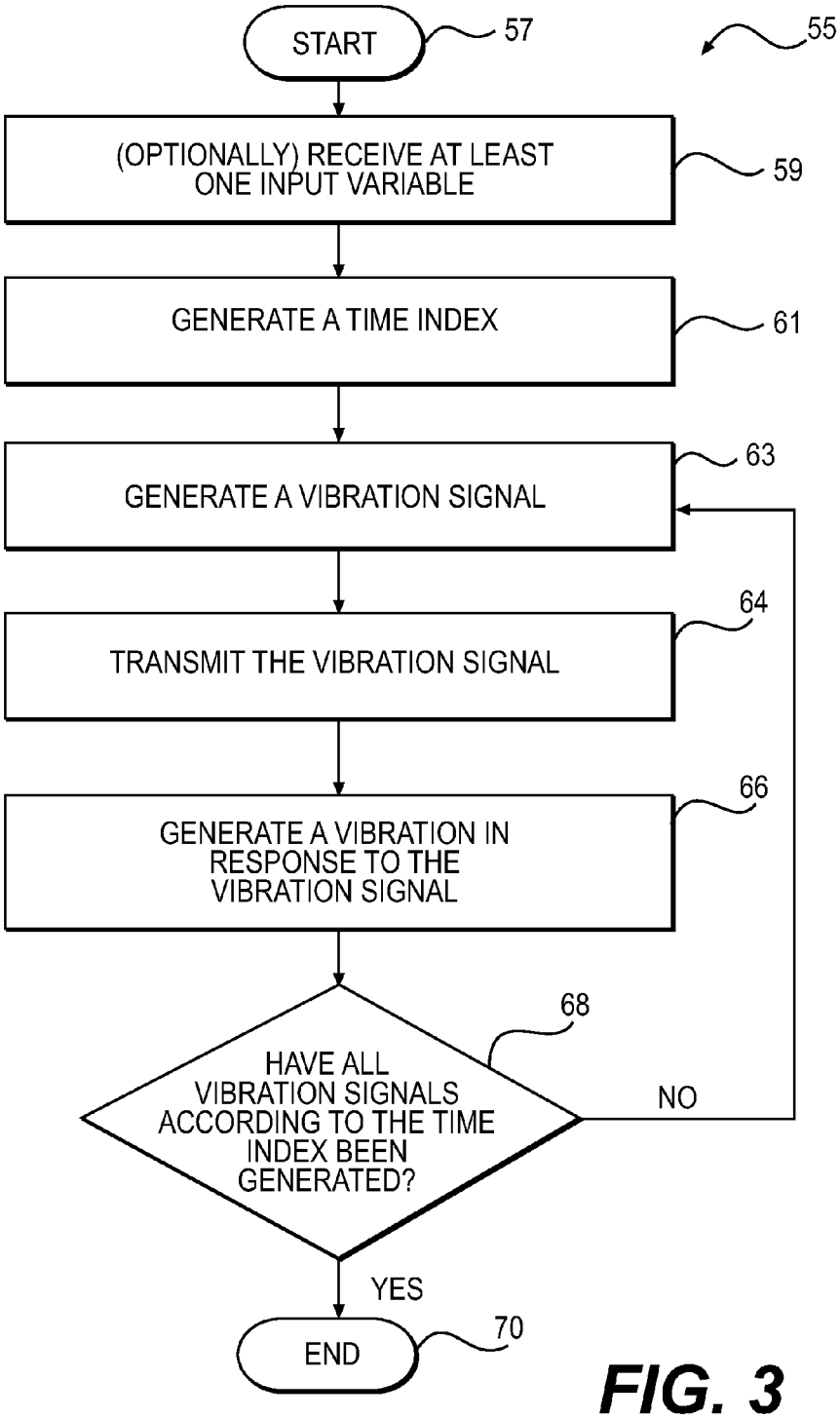
FIG. 3 is a flow chart illustrating one method contemplated by the present invention.

FIG. 3 is a flow chart that illustrates one contemplated method 54 of operation of the present invention.

The method 55 starts at step 57.

The method 55 proceeds to step 59 where the processor 14 optionally receives at least one input variable. The input variable may be the speed of the vehicle 12 transmitted by the speedometer 42 or a time signal from the clock 46. Still further, the input variable may be provided via the transmitter/receiver 50. As should be apparent from the foregoing, additional input variables may be received by the processor 14 without departing from the scope of the present invention.

If no input variables are received, the method 55 proceeds to step 61, where the processor 14 generates a time index for the subsequent generation and transmission of vibration signals.

With respect to one contemplated embodiment of the present invention, the step 61 is anticipated to generate a time index that includes the timing for the transmission of at least three vibration signals. The three signals are separated from one another by at least two time intervals. As noted above, to avoid a person becoming familiar with a repetitive pattern, immediately consecutive time intervals preferably are non-equal. This does not preclude two time intervals in a long time index from being equal to one another, but it does prevent the driver from anticipating the duration of a subsequent time interval.

In the alternative, as noted above, successive time intervals may be equal without departing from the scope of the present invention.

At step 63, the method 55 generates a vibration signal according to the time index that was established in step 59.

The method 55 then executes step 64, where the method transmits the vibration signal to at least one of the vibration generators 16, 18, 20.

At step 66, one or more of the vibration generators 16, 18, 20 responds to the vibration signal to generate vibrations that are perceptible by the driver.

At step 68, the method 55 determines if all of the vibration signals according to the time index have been generated. If all of the vibration signals have been generated, the method 55 proceeds to the end step 70. If all of the vibration signals have not been generated according to the time index, the method returns to step 63, where the next vibration signal is generated according to the time index.

With respect to the time index, it is noted that the time index may be an adaptable time schedule. In other words, once generated, the time index need not be inflexible until after all of the vibration signals have been generated. It is contemplated that one or more inputs may change the time index before all of the vibration signals have been generated. This input is anticipated to result in a change in the time index, which is modified to adapt to the additional input provided to the sleep disruptor 34.

As indicated above, the processor 14 may issue alarm signals to a speaker 54 either together with one or more of the vibration signals. The processor 14 also may issue alarm signals separate from the vibration signals to enhance the sleep disruptive operation of the present invention. As should be apparent, the speaker 54 may be one or more of the speakers connected to a radio (or other sound equipment) in the vehicle 12. In other words, the speaker 54 need not operate independently from the remaining equipment available to the driver.

In an alternative embodiment, the speaker 54 may not provide an audible alarm in the traditional sense of an alarm. In this second embodiment, the speaker 54 may play receive and play audio programming, as an audible alarm, from one or more media players 58. As such, the speaker 54 may play audio content that is available through the radio, an audio file player (i.e., a player of digital audio files, such as an iPod available from Apple Corp. of Cupertino, Calif.), a compact disk ("CD") player, a digital video disk ("DVD") player, a tablet, a smartphone, or the like.

As illustrated in FIG. 2, it is contemplated that the processor 14 may issue a command to the media player 58 to provide output to the speakers 54 via the communication line 60. Alternatively, output from the media player 58 may be routed, via the communication line 62, through the processor 14 to the speakers 54.

It is also contemplated that the audio alarm may be disabled by the driver. In instances where there are passengers in the vehicle 12 in addition to the driver, it may be prudent not to disrupt the comfort of the passengers. As a result, it is contemplated that the driver may disable the audible alarm feature, relying instead on the features to disrupt sleepiness without the audible alarm.

It is also contemplated that the sleep disruptor 10 present invention may include connections between the processor 14 and other devices that are available in or on the vehicle 12. Since one goal of the present invention is to generate stimuli at random intervals to return a driver to a more alert state, the processor 14 may be connected to the windshield wipers on an automobile 12. With such a connection, it is contemplated that the processor 14 might activate the windshield wipers at random time intervals to further vary the stimuli presented to the driver. In another contemplated embodiment, the processor 14 may be connected to the interior lights in the vehicle 12 to turn the lights on and off at random time intervals. Still further, where the vehicle 12 includes electromechanically-adjustable seats, it is contemplated that the processor 14 may adjust the position of the seat at random time intervals. Additionally, vibration generators may be provided in the pedals and/or the gear shift to provide additional locations to which vibrations may be applied in the vehicle 12. As should be apparent, there are still further devices that are available within a vehicle 12 where the processor 14 may alter the operational characteristics thereof to present the driver with a variety of stimuli to return the driver to a more alert condition.

As noted above, it is contemplated that the sleep disruptor 10 of the present invention may be turned on or off at the discretion of the user. It is also contemplated that portions of the apparatus of the present invention may be turned on or off at the discretion of the user, permitting the operation of the apparatus to be customized for user preferences.

Finally, it is noted that, while the sleep disruptor 10 present invention is described in connection with the presentation of stimuli to a driver, the sleep disruptor 10 may be employed in one or more passenger seats of the vehicle 12 without departing from the scope of the present invention.

As noted above, the present invention is described in connection with one or more embodiments thereof. The embodiments are intended to be illustrative of the breadth of the present invention. Focus on any one particular embodiment is not intended to be limiting thereof. The present invention, therefore, is intended to encompass variations and equivalents, as would be appreciated by those skilled in the art.

What is claimed is:

1. A sleep disrupting apparatus disposed in a vehicle, comprising:

a processor; and at least one vibration generator connected to the processor, the at least one vibration generator being disposed in the vehicle in a position proximate to a passenger such that vibrations generated by the vibration generator are transmitted to the passenger;

wherein the processor determines a time index, generates at least three vibration signals consistent with the time index, and transmits the three vibration signals to the at least one vibration generator, and wherein the three vibration signals are separated from one another by two time intervals, and wherein at least one of the two time intervals are not equal to one another or successive vibration signals have unequal intensities.

2. The sleep disrupting apparatus of claim 1, wherein the at least one vibration generator comprises two vibration generators.

3. The sleep disrupting apparatus of claim 2, wherein the two vibration generators are disposed within the seat and the backrest of a driver's seat in the vehicle.

4. The sleep disrupting apparatus of claim 1, wherein the at least one vibration generator comprises three vibration generators.

5. The sleep disrupting apparatus of claim 4, wherein the three vibration generators are disposed within a seat, a backrest, and a steering wheel of the vehicle.

6. The sleep disrupting apparatus of claim 1, further comprising:

an input device connected to the processor to provide input from a user to the processor.

7. The sleep disrupting apparatus of claim 1, further comprising:

a speedometer that measures a speed of the vehicle and generates a speed signal that is transmitted to the processor and received as input by the processor.

8. The sleep disrupting apparatus of claim 1, further comprising:

a clock connected to the processor that generates a clock signal that is transmitted to the processor and received as input by the processor.

9. The sleep disrupting apparatus of claim 1, further comprising:

a speaker connected to the processor to generate an audible alarm in response to an alarm signal from the processor.

10. The sleep disrupting apparatus of claim 1, further comprising:

a transmitter/receiver connected to the processor to transmit signals from the processor and receive signals to be sent to the processor.

11. The sleep disrupting apparatus of claim 1, wherein the passenger is a driver of the vehicle.

12. A method for disrupting sleep of a passenger of a vehicle, comprising:

via a processor, generating a time index setting a timing for the generation of at least three consecutive vibration signals, wherein the at least three consecutive vibration signals are separated from one another by two consecutive time intervals;

via the processor, generating a vibration signal;

via the processor, transmitting the vibration signal to at least one vibration generator disposed within the vehicle in proximity to a passenger such that vibrations generated by the vibration generator are transmitted to the passenger;

via the at least one vibration generator, generating a vibration responsive to the vibration signal;

via the processor, determining if all of the at least three vibration signals have been transmitted; and if all of the vibration signals have not been transmitted, returning to the step of generating a vibration signal to generate a subsequent vibration signal, wherein at least one of the two time intervals are not equal to one another or successive vibration signals have unequal intensities.

13. The method of claim 12, further comprising:

receiving at least one input variable by the processor.

14. The method of claim 13, wherein the at least one input variable is provided from the passenger via an input device.

15. The method of claim 14, wherein the first time interval is not equal to the second time interval.

16. The method of claim 12, wherein the at least two time intervals comprise a first time interval followed by a second time interval.

17. The method of claim 12, further comprising:

via the processor, generating an alarm signal;

via the processor, transmitting the alarm signal to a speaker; and via the speaker, generating an audible alarm.

18. The method of claim 12, wherein the at least one vibration generator comprises three vibration generators disposed in a seat, a backrest, and a steering wheel of the vehicle.

* * * * *